US006538417B2

(12) United States Patent
Marty et al.

(10) Patent No.: US 6,538,417 B2
(45) Date of Patent: Mar. 25, 2003

(54) VOLTAGE REGULATING DEVICE AND PROCESS

(75) Inventors: Nicolas Marty, Claix (FR); Régis Robert, St. Martin d'Heres (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/017,911

(22) Filed: Dec. 14, 2001

(65) Prior Publication Data

US 2002/0093322 A1 Jul. 18, 2002

(30) Foreign Application Priority Data

Dec. 27, 2000 (FR) ..... 00 17115

(51) Int. Cl.[7] ..... G05F 1/40
(52) U.S. Cl. ..... 323/282; 323/284
(58) Field of Search ..... 323/282, 283, 323/284, 289, 349, 351

(56) References Cited

U.S. PATENT DOCUMENTS

| | | | | |
|---|---|---|---|---|
| 5,319,302 A | | 6/1994 | Koshikawa et al. | 323/273 |
| 5,367,247 A | * | 11/1994 | Blocher et al. | 323/222 |
| 5,469,046 A | * | 11/1995 | Wong et al. | 323/286 |
| 5,528,125 A | * | 6/1996 | Marshall et al. | 323/222 |
| 5,570,004 A | * | 10/1996 | Shibata | 323/303 |
| 6,031,364 A | | 2/2000 | Hosono et al. | 323/285 |
| 6,127,815 A | * | 10/2000 | Wilcox | 323/282 |
| 6,150,804 A | | 11/2000 | Taghizadeh-Kaschani | 323/285 |
| 6,424,132 B1 | * | 7/2002 | Wrathall | 323/282 |
| 6,452,368 B1 | * | 9/2002 | Basso et al. | 323/282 |
| 6,456,051 B2 | * | 9/2002 | Darzy | 323/284 |

FOREIGN PATENT DOCUMENTS

EP 0 742 509 11/1996 ..... G05F/1/575

* cited by examiner

*Primary Examiner*—Adolf Deneke Berhane
(74) *Attorney, Agent, or Firm*—Allen, Dyer, Doppelt, Milbrath & Gilchrist, P.A.; Lisa K. Jorgenson

(57) ABSTRACT

A voltage regulating device includes a comparison circuit for comparing a voltage proportional to an output voltage to a fixed reference voltage. The fixed reference voltage is received on a first input and the voltage proportional to an output voltage is received on a second input. The voltage regulating device further includes a variable resistance-forming circuit controlled by the output of the comparison circuit and disposed so that the output voltage remains substantially constant. The voltage regulating device may be supplied with a variable input voltage. The voltage regulating device further includes a second comparison circuit so that the output voltage remains substantially constant if the input voltage is greater than a threshold, and substantially equal to the input voltage if the input voltage is less than the threshold.

30 Claims, 3 Drawing Sheets

VOLTAGE REGULATING DEVICE AND PROCESS

FIELD OF THE INVENTION

The present invention relates to the field of voltage regulation, and, more particularly, to voltage regulation for providing a constant supply voltage from a variable input voltage.

BACKGROUND OF THE INVENTION

Voltage regulators are used very widely in supply circuits. Voltage regulators make it possible to provide supply voltages with low power losses. When the energy source is a battery, it is important for the consumption of the voltage regulator or regulators to be low. This is especially important when the batteries of mobile telephones have small dimensions and whether the mobile telephone is in active mode or in standby mode.

In general, the performance of voltage regulators, in terms of output current consumption, is guaranteed down to a minimum battery voltage above their output voltage. The difference between the minimum voltage of the battery and the output voltage of the regulators is often referred to as the drop voltage, denoted $V_{drop}$.

In the case of a battery voltage, which is below the abovementioned threshold, many regulators are disabled. However, in the case of mobile telephones, the voltage regulators, which supply the real-time clock part, may remain operationally active with degraded performance. In this case, the output voltage of the regulator is imposed by the supply, and may therefore no longer reach the desired voltage. Thus, the feedback loop of the voltage regulator can no longer follow the preset. The regulator goes out of balance, thereby creating a debiasing of certain transistors and an over consumption in the comparison-amplification stage.

SUMMARY OF THE INVENTION

The invention provides an improved voltage regulator. The invention provides regulation adapted to a low battery voltage that induces no over consumption, is economical to produce and can be easily integrated. The invention provides a voltage regulator having low consumption regardless of the input voltage.

The voltage regulating device, according to an aspect of the invention, comprises a means of comparison of a voltage proportional to an output voltage and of a fixed reference voltage, the fixed reference voltage being received on a first input and the voltage proportional to an output voltage being received on a second input, and a variable resistance-forming means controlled by the output of the means of comparison and disposed in such a way that the output voltage remains substantially constant.

The device is supplied with an input voltage, which may vary. The device comprises another means of a voltage proportional to the input voltage and of the fixed reference voltage. The device comprises a switching means controlled by the output of the other means of comparison so as to send the fixed reference voltage to the first input of the means of comparison if the fixed reference voltage is less than the voltage proportional to the input voltage, and to send the voltage proportional to the input voltage to the first input of the means of comparison if the fixed reference voltage is greater than the voltage proportional to the input voltage, in such a way that the output voltage remains substantially constant if the input voltage is greater than a threshold, and substantially equal to the input voltage if the input voltage is less than the threshold.

In one embodiment of the invention, the means of comparison comprises an amplifier-comparator and the variable resistance-forming means comprises a MOS transistor. In one embodiment of the invention, the device comprises two resistors in series between the output of the variable resistance-forming means and a ground, the voltage proportional to an output voltage being tapped off at the point common to the two resistors.

Preferably, the other means of comparison comprises a hysteresis-type comparator. In one embodiment of the invention, the device comprises two resistors in series between the input voltage and a ground, the voltage proportional to an input voltage being tapped off at the point common to the two resistors. Preferably, the switching means comprises two breakers, each controlled by the output of the other means of comparison, the first able to set the first input of the means of comparison to the fixed reference voltage $V_{ref}$, the second able to set the first input of the means of comparison to the voltage $V_{pve}$ proportional to the input voltage $V_e$.

In one embodiment of the invention, the first breaker is on and the second breaker is off if the fixed reference voltage is less than the voltage proportional to the input voltage. The first breaker is off and the second breaker is on if the fixed reference voltage is greater than the voltage proportional to the input voltage. In one embodiment of the invention, the device is associated with a supply battery. The invention also relates to a portable system of the mobile telephone type comprising a device as described above.

The invention also provides a voltage regulating process, comprising steps of comparing a voltage proportional to an input voltage which may vary and of a fixed reference voltage, fixing a comparison voltage equal to the fixed reference voltage if the fixed reference voltage is less than the voltage proportional to the input voltage and equal to the voltage proportional to the input voltage if the fixed reference voltage is greater than the voltage proportional to the input voltage. The steps may further include comparing the comparison voltage and a voltage proportional to an output voltage, and varying the value of a resistor as a function of the comparison in such a way that the output voltage remains substantially constant if the input voltage is greater than a threshold, and substantially equal to the input voltage if the input voltage is less than the threshold.

Stated otherwise, during normal operation, the regulated voltage is compared with a fixed reference voltage of the circuit. From the moment that the input voltage of the regulator is too low, the preset can no longer be reached and the output voltage will fall and cause the system to go out of balance. The invention makes it possible to retain a single bias while preserving the balance of the system. To do this, the value of the minimum permitted voltage supply is detected and, from this instant onwards, the present invention uses a reference proportional to the supply rather than a fixed reference. The proportional reference will decrease with the supply and the regulation may therefore be preserved and over consumption avoided.

To detect of the mode of low supply voltage, also referred to as drop-out, a hysteresis-type comparator compares the fixed reference voltage $V_{ref}$ with a fraction of the supply voltage $V_e$. If $V_{ref}>k\times V_e$, then the present invention switches to drop-out mode. Conversely, if $V_{ref}<k\times V_e$, then the present invention switches to normal mode. The output of the hysteresis-type comparator will make it possible to control two breakers, which will send the fixed reference voltage $V_{ref}$ or the variable voltage $V_{pve}$ to the input of a comparator to serve as the reference voltage.

BRIEF DESCRIPTION OF THE DRAWINGS

The present invention will be better understood and other advantages will become apparent on reading the detailed description of an embodiment taken by way of a non-limiting example and illustrated by the appended drawings, in which.

DETAILED DESCRIPTION OF PREFERRED EMBODIMENTS

Figure 1:
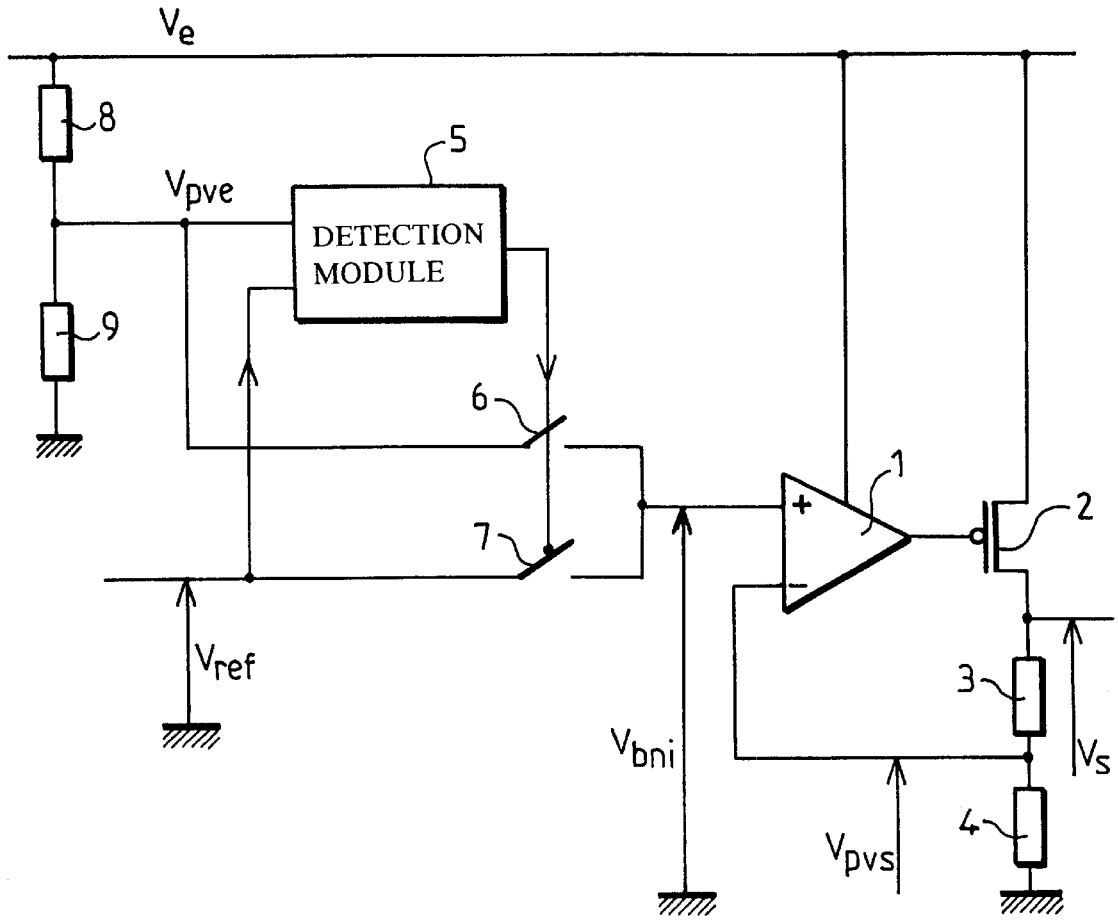
FIG. 1 is a diagrammatic view of a device according to an embodiment of the invention.

As may be seen in FIG. 1, the regulating device comprises a comparator 1, a MOS transistor 2 forming a power amplifier whose gate is linked to the output of the amplifier 1, two resistors 3 and 4 mounted in series between the source of the transistor 2 and a ground of the circuit. The output voltage $V_s$ is tapped off at the common point between the source of the transistor 2 and the resistor 3. The resistors 3 and 4 form a voltage divider and a voltage $V_{pvs}$ is tapped off at the common point between the resistors 3 and 4. The voltage $V_{pvs}$ is proportional to the output voltage $V_s$ and determined by: $V_{pvs}=V_s\times R4/(R3+R4)$, R3 and R4 being the values of the resistors 3 and 4, respectively.

An input voltage $V_e$ is provided to the device, for example by a battery, not represented, or else by any other kind of supply device. The drain of the transistor 2 is set to the voltage $V_e$. The amplifier 1 is also supplied with the input voltage $V_e$. The point common to the resistors 3 and 4 is linked to the inverting terminal of the amplifier 1, so that the terminal is subjected to the voltage $V_{pvs}$.

The regulating device comprises a module 5 for detecting the drop-out mode, stated otherwise, the degraded mode of operation due to an input voltage $V_e$ which is less than a predetermined threshold, two breakers 6 and 7 controlled by the detection module 5, and two resistors 8 and 9 mounted in series between a regulating device input subjected to the input voltage $V_e$ and a ground of the device. The point common to the resistors 8 and 9 is at a voltage $V_{pve}$ proportional to the input voltage $V_e$ with $V_{pve}=V_e\times R9/(R8+R9)$, with R8 and R9 being the values of the resistors 8 and 9, respectively. The voltage $V_{pve}$ is provided, on one hand to the detection module 5 and, on the other hand, to a terminal of the breaker 6. A fixed reference voltage $V_{ref}$ provided by another circuit, not represented, is sent, on one hand, to an input of the detection module 5 and, on the other hand, to a terminal of the breaker 7.

The other terminal of the breaker 6 is linked to the non-inverting input of the amplifier 1. The other terminal of the breaker 7 is also linked to the non-inverting input of the amplifier 1. The breakers 6 and 7 are controlled oppositely, so that one is a closed circuit while the other is an open circuit, and vice versa. The regulating device operates in the following manner. In normal mode, the breaker 6 is an open circuit, and the breaker 7 is a closed circuit. The voltage $V_{pvs}$ proportional to the output voltage $V_s$ is compared with the fixed reference voltage $V_{ref}$.

In degraded or drop-out mode, the breaker 6 is a closed circuit and the breaker 7 is an open circuit. The non-inverting terminal of the amplifier 1 is then subjected to the voltage $V_{pve}$ proportional to the input voltage $V_e$. The voltages $V_{pvs}$ and $V_{pve}$ are compared. The voltage $V_{pve}$ forms a reference voltage proportional to the supply. The output voltage $V_s$ therefore evolves as a function of the input voltage $V_e$, but while keeping the transistor 2 and the amplifier 1 suitably biased, thereby avoiding over-consumption.

The detection module 5 performs a comparison between the voltage $V_{pve}$ proportional to the input voltage $V_e$ and the fixed reference voltage $V_{ref}$. If the fixed reference voltage $V_{ref}$ is greater than the voltage $V_{pve}$, then the degraded mode obtains and the detection module 5 turns on the breaker 6 and turns off the breaker 7. If the fixed reference voltage $V_{ref}$ is less than the voltage $V_{pve}$, then the supply voltage $V_e$ is high enough to go to normal operation. The detection module 5 turns off the breaker 6 and turns on the breaker 7.

Figure 2:
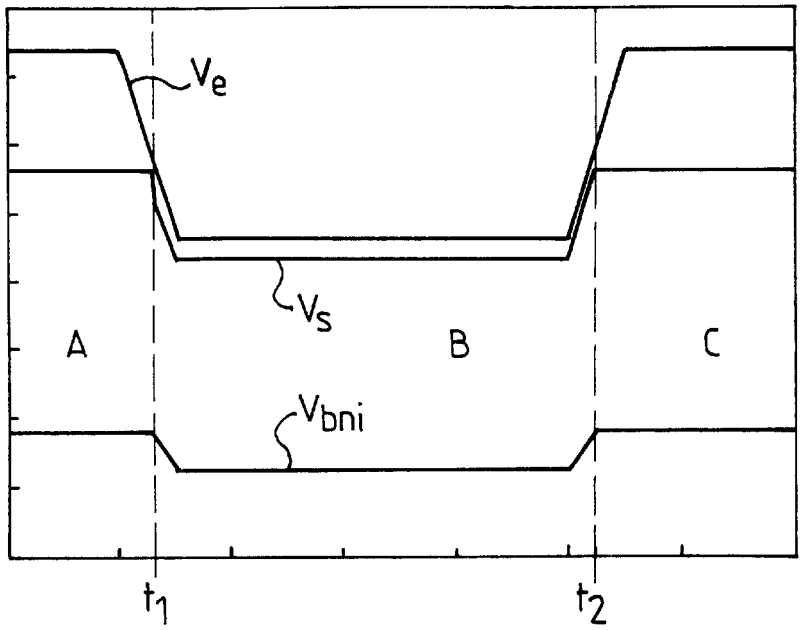
FIG. 2 is a timing diagram showing the evolution of the voltages of the device shown in FIG.1.
Figure 3:
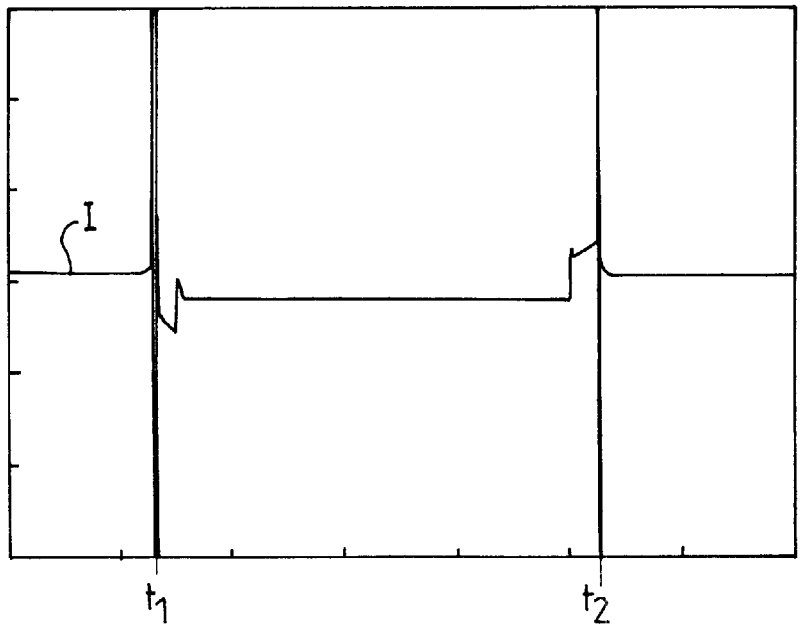
FIG. 3 is a timing diagram showing the evolution of the current consumed by the device shown in FIG. 1.

The manner of operation will be better understood by studying the curves illustrated in FIGS. 2 and 3, in which time appears as abscissa and voltage or current as ordinate. Represented in FIG. 2 is the evolution of the input voltage $V_e$, of the output voltage or regulated voltage $V_s$ and of the voltage $V_{bni}$ present on the non-inverting terminal of the amplifier 1 of FIG. 1 and equal either to $V_{ref}$ or to $V_{pve}$.

Shown in FIG. 3 is the evolution of the current I consumed by the regulating device, with the same time scale as FIG. 2. In a zone A, the input voltage $V_e$ is sufficient. The device operates in normal mode with an output voltage, for example equal to 3.3 volts. The reference voltage present on the non-inverting terminal is equal to the fixed reference voltage $V_{ref}$, for example 1.4 volts.

Then, the input voltage $V_e$ begins to drop, and we then go to phase B. At time t1, the detection module 5 senses that the reference voltage $V_{ref}$ is becoming greater than the voltage $V_{pve}$ and causes the breakers 6 and 7 to switch. The voltage $V_{bni}$ of the non-inverting terminal of the amplifier 1 then becomes equal to the voltage $V_{pve}$. A decrease in the regulated output voltage $V_s$ is permitted. Therefore, $V_{bni}=V_{pve}=V_{pvs}$, and $V_{pvs}=V_s\times R4/(R3+R4)$. From this, it is deduced that $V_s=V_{pve}\times(R3+R4)/R4$. From this, it is further deduced that $V_s=V_e\times R9\times(R3+R4)/((R8+R9)\times R3))$. Thus, the output voltage $V_s$ proportionally evolves to the input voltage $V_e$ in degraded mode, as shown in phase B of FIG. 2.

At time t2, the voltage $V_{pve}$ again becomes greater than the fixed reference voltage $V_{ref}$. The detection module decides to go back to normal mode and causes the breakers 6 and 7 to switch. Again, $V_{bni}=V_{ref}=V_{pvs}$ and, therefore, $V_s=V_{ref}\times(R3+R4)/R3$. The consumption of current, as illustrated in FIG. 3, remains low and generally less in degraded mode than the consumption in normal mode. This is to be compared with the consumption of a regulator according to the prior art, for which the current, in degraded mode, was three or four times greater than the current consumed in normal mode.

Figure 4:
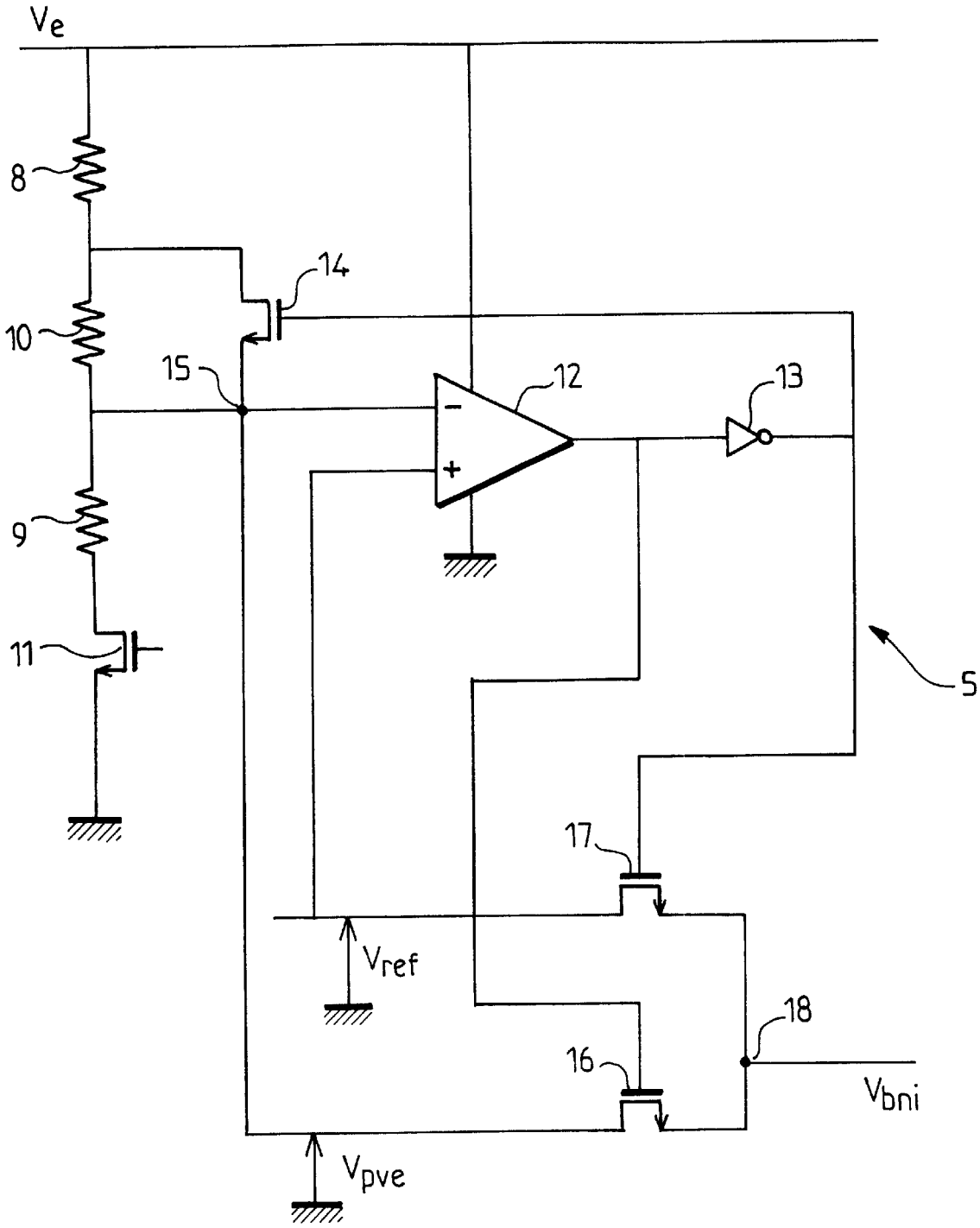
FIG. 4 is a more detailed diagrammatic view of the device shown in FIG. 1.

The regulating device can easily be embodied in integrated technology and belong to an integrated circuit providing multiple other functions. Illustrated in greater detail in FIG. 4 is the structure of the detection module 5. Furthermore, there is provided an additional resistor 10 mounted between the resistors 8 and 9, and a MOS transistor 11 forming a breaker, mounted between the resistor 9 and the earth of the circuit.

The detection module 5 comprises a comparator 12 supplied with the supply voltage $V_e$ and also linked to the ground. The output of the comparator 12 is linked to an inverter 13. The detection module 5 furthermore comprises a MOS transistor forming a breaker, mounted in parallel with the resistor 10 between the point common to the resistors 8 and 10 and the point 15 common to the resistors 10 and 9. The gate of the MOS transistor 14 is linked to the output of the inverter 13.

The point 15 is also linked to an inverting input of the comparator 12, while a non-inverting input is subjected to the reference voltage $V_{ref}$. The output of the comparator 12 is also linked to the gate of a MOS transistor 16, which forms a breaker, whose drain is linked to the point 15 and whose source is linked to a point 18. The output of the inverter 13 is also linked to the gate of a MOS transistor 17 forming a breaker, whose drain is subjected to the reference voltage $V_{ref}$ and whose source is also linked to the point 18 which experiences the voltage $V_{bni}$ and can be linked to the non-inverting input of the comparator 1 of FIG. 1.

In normal operation, the voltage $V_{pve}$ at the point 15 is greater than the reference voltage $V_{ref}$. The output of the comparator 12 is therefore at the 0 level and that of the inverter 13 at the 1 level. The transistor 16 is off, while the transistor 17 is on. Therefore, $V_{bni}=V_{ref}$. The gate of the transistor 14 is set to the 1 level. The transistor 14 is therefore on and the resistor 10 short-circuited, thereby tending to raise the level of the voltage $V_{pve}$. Thus, $V_{pve}=V_e \times R9/(R8+R9)$. In degraded or drop-out operation, the voltage $V_{ref}$ is greater than the voltage $V_{pve}$. The output of the comparator 12 is at the 1 level and the output of the inverter 13 as at the 0 level. The transistor 16 is on and the transistor 17 is off. Therefore, $V_{bni}=V_{pve}$.

The transistor 14 whose gate is at the 0 level is off and the point 15 is therefore subjected to the voltage tapped off between the resistors 9 and 10. Therefore, $V_{pve}=V_e \times R9/(R8+R9+R10)$. The transistor 14 makes it possible to create a hysteresis effect, which tends to stabilize the operation of the detection module 5 and avoids overly frequent changes of state.

The transistor 11 is controlled in such a way that it is on as soon as the detection module 5 is used. The breaker 11 is off in the other cases, thereby avoiding losses of energy going into the resistors 8, 9 and 10, and therefore avoiding the flow of a current equal to $V_e/(R8+R9+R10)$ when the detection module 5 is inactive. The consumption of current is thus reduced and the self-sufficiency of a battery-supplied apparatus, for example a mobile telephone handset, is increased.

That which is claimed is:

1. A voltage regulating device comprising:

a first input terminal for receiving a fixed reference voltage;

a second input terminal for receiving a voltage proportional to an output voltage of the device;

first comparison means having a first input terminal and a second input terminal and for comparing the voltage proportional to the output voltage with the fixed reference voltage;

variable resistance-forming means controlled by an output of said first comparison means and for tapping off the voltage proportional to the output voltage so that the output voltage remains substantially constant;

second comparison means connected to said first input terminal and for comparing a voltage proportional to a variable input voltage of the device and the fixed reference voltage; and switching means controlled by an output of said second comparison means and for sending the fixed reference voltage to the first input terminal of said first comparison means when the fixed reference voltage is less than the voltage proportional to the variable input voltage, and for sending the voltage proportional to the variable input voltage to said first input terminal of said first comparison means when the fixed reference voltage is greater than the voltage proportional to the variable input voltage so that the output voltage remains substantially constant when the variable input voltage is greater than a threshold voltage, and the output voltage remains substantially equal to the variable input voltage when the variable input voltage is less than the threshold voltage.

2. A voltage regulating device according to claim 1, wherein said first comparison means comprises an amplifier-comparator connected to said second input terminal, said switching means and said variable resistance-forming means; and said variable resistance-forming means comprises a MOS transistor having a gate connected to the output of said first comparison means.

3. A voltage regulating device according to claim 1, wherein said variable resistance-forming means further comprises a first resistor and a second resistor connected in series between an output voltage terminal and a ground terminal, and the voltage proportional to the output voltage is tapped off at a midway point between said first and said second resistors.

4. A voltage regulating device according to claim 1, wherein said second comparison means comprises a hysteresis-type comparator connected to the first input terminal.

5. A voltage regulating device according to claim 1, further comprising a third resistor and a fourth resistor connected in series between a variable input voltage terminal and a second ground terminal, and the voltage proportional to the variable input voltage is tapped off at a midway point between said third and fourth resistors.

6. A voltage regulating device according to claim 1, wherein said switching means comprises:

a first breaker controlled by the output of said second comparison means, and for supplying the fixed reference voltage to the first input terminal of said first comparison means; and a second breaker controlled by the output of said second comparison means, and for supplying the voltage proportional to the variable input voltage to the first input terminal of said first comparison means.

7. A voltage regulating device according to claim 6, wherein said first breaker is on and said second breaker is off when the fixed reference voltage is less than the voltage proportional to the variable input voltage, and said first breaker is off and said second breaker is on when the fixed reference voltage is greater than the voltage proportional to the variable input voltage.

8. A voltage regulating device according to claim 7, further comprising a battery connected thereto and for supplying the variable input voltage.

9. A voltage regulating device comprising:

a first input terminal for receiving a fixed reference voltage;

a second input terminal for receiving a voltage proportional to an output voltage of the device;

a first comparison circuit having a first input terminal and a second input terminal and for comparing the voltage proportional to the output voltage with the fixed reference voltage;

a variable resistance-forming circuit controlled by an output of said first comparison circuit and for tapping off the voltage proportional to the output voltage so that the output voltage remains substantially constant;

a second comparison circuit connected to said first input terminal and for comparing a voltage proportional to a variable input voltage of the device and the fixed reference voltage; and a switching circuit controlled by an output of said second comparison circuit and for sending the fixed reference voltage to said first comparison circuit when the fixed reference voltage is less than the voltage proportional to the variable input voltage, and for sending the voltage proportional to said first input terminal of said first comparison circuit when the fixed reference voltage is greater than the voltage proportional to the variable input voltage so that the output voltage remains substantially constant if the variable input voltage is greater than a threshold voltage, and the output voltage remains substantially equal to the variable input voltage when the variable input voltage is less than the threshold voltage.

10. A voltage regulating device according to claim 9, wherein said first comparison circuit comprises an amplifier-comparator connected to said second input terminal, said switching circuit and said variable resistance-forming circuit; and said variable resistance-forming circuit comprises a MOS transistor having a gate connected to the output of said first comparison circuit.

11. A voltage regulating device according to claim 9, wherein said variable resistance-forming circuit further comprises a first resistor and a second resistor connected in series between an output voltage terminal and a ground terminal, and the voltage proportional to the output voltage is tapped off at a midway point between said first and said second resistors.

12. A voltage regulating device according to claim 9, wherein said second comparison circuit comprises a hysteresis-type comparator connected to the first input terminal.

13. A voltage regulating device according to claim 9, further comprising a third resistor and a fourth resistor connected in series between a variable input voltage terminal and a second ground terminal, and the voltage proportional to the variable input voltage is tapped off at a midway point between said third and fourth resistors.

14. A voltage regulating device according to claim 9, wherein said switching circuit comprises:

a first breaker controlled by the output of said second comparison circuit, and for supplying the fixed reference voltage to said first comparison circuit; and a second breaker controlled by the output of said second comparison circuit, and for supplying the voltage proportional to the variable input voltage to said first comparison circuit.

15. A voltage regulating device according to claim 14, wherein said first breaker is on and said second breaker is off when the fixed reference voltage is less than the voltage proportional to the variable input voltage, and said first breaker is off and said second breaker is on when the fixed reference voltage is greater than the voltage proportional to the variable input voltage.

16. A voltage regulating device according to claim 15, further comprising a battery connected thereto and for supplying the variable input voltage.

17. A mobile telephone system comprising:

a mobile telephone; and a device connected to said mobile telephone and comprising a first input terminal for receiving a fixed reference voltage, a second input terminal for receiving a voltage proportional to an output voltage of the device, a first comparison circuit having a first input terminal and a second input terminal and for comparing the voltage proportional to the output voltage with the fixed reference voltage, a variable resistance-forming circuit controlled by an output of said first comparison circuit and for tapping off the voltage proportional to the output voltage so that the output voltage remains substantially constant, a second comparison circuit connected to said first input terminal and for comparing a voltage proportional to a variable input voltage of the device and the fixed reference voltage, and a switching circuit controlled by an output of said second comparison circuit and for sending the fixed reference voltage to the first input terminal of said first comparison circuit when the fixed reference voltage is less than the voltage proportional to the variable input voltage, and for sending the voltage proportional to the variable input voltage to said first input terminal of said first comparison circuit when the fixed reference voltage is greater than the voltage proportional to the variable input voltage so that the output voltage remains substantially constant when the variable input voltage is greater than a threshold voltage, and the output voltage remains substantially equal to the variable input voltage when the variable input voltage is less than the threshold voltage.

18. A mobile telephone system according to claim 17, wherein said first comparison circuit comprises an amplifier-comparator connected to said second input terminal, said switching circuit and said variable resistance-forming circuit; and said variable resistance-forming circuit comprises a MOS transistor having a gate connected to the output of said first comparison circuit.

19. A mobile telephone system according to claim 17, wherein said variable resistance-forming circuit further comprises a first resistor and a second resistor connected in series between an output voltage terminal and a ground terminal, and the voltage proportional to the output voltage is tapped off at a midway point between said first and said second resistors.

20. A mobile telephone system according to claim 17, wherein said second comparison circuit comprises a hysteresis-type comparator connected to the first input terminal.

21. A mobile telephone system according to claim 17, further comprising a third resistor and a fourth resistor connected in series between a variable input voltage terminal and a second ground terminal, and the voltage proportional to the variable input voltage is tapped off at a midway point between said third and fourth resistors.

22. A mobile telephone system according to claim 17, wherein said switching circuit comprises:

a first breaker controlled by the output of said second comparison circuit, and for supplying the fixed reference voltage to the first input terminal of said first comparison circuit; and a second breaker controlled by the output of said second comparison circuit, and for supplying the voltage proportional to the variable input voltage to the first input terminal of said first comparison circuit.

23. A mobile telephone system according to claim 22, wherein said first breaker is on and said second breaker is off when the fixed reference voltage is less than the voltage proportional to the variable input voltage, and said first breaker is off and said second breaker is on when the fixed reference voltage is greater than the voltage proportional to the variable input voltage.

24. A mobile telephone system according to claim 23, further comprising a battery connected thereto and for supplying the variable input voltage.

25. A method for regulating voltage comprising:

comparing a voltage proportional to a variable input voltage with a fixed reference voltage;

generating a comparison voltage equal to the fixed reference voltage when the fixed reference voltage is less than the voltage proportional to the variable input voltage, and equal to the voltage proportional to the variable input voltage when the fixed reference voltage is greater than the voltage proportional to the variable input voltage;

comparing the comparison voltage with a voltage proportional to an output voltage; and varying the value of a resistor, as a function of the comparison between the comparison voltage and the voltage proportional to the output voltage so that the output voltage remains substantially constant when the variable input voltage is greater than a threshold voltage, and the output voltage is substantially equal to the variable input voltage when the variable input voltage is less than the threshold voltage.

26. A method according to claim 25, further comprising:

receiving the fixed reference voltage at a first input terminal of a voltage regulating device; and receiving the voltage proportional to the output voltage at a second input terminal of the voltage regulating device.

27. A method according to claim 26, wherein the voltage regulating device comprises an amplifier-comparator for comparing the comparison voltage with a voltage proportional to the output voltage, a switching circuit for generating the comparison voltage and a variable resistance-forming circuit for varying the value of the resistor.

28. A method according to claim 27, wherein the variable resistance-forming circuit comprises a first resistor and a second resistor connected in series between an output voltage terminal and a ground terminal; and further comprising tapping off the voltage proportional to the output voltage at a midway point between the first and the second resistors.

29. A method according to claim 27, wherein the voltage regulating device further comprises a hysteresis-type comparator connected to the first input terminal for controlling the switching circuit.

30. A method according to claim 26, wherein the voltage regulating device further comprises a third resistor and a fourth resistor connected in series between a variable input voltage terminal and a second ground terminal; and further comprising tapping off the voltage proportional to the variable input voltage at a midway point between the third and fourth resistors.

* * * * *